US007566058B1

(12) United States Patent
Itkis

(10) Patent No.: US 7,566,058 B1
(45) Date of Patent: Jul. 28, 2009

(54) BINGO FLASHBOARD AND VERIFIER

(75) Inventor: Yuri Itkis, Las Vegas, NV (US)

(73) Assignee: Fortunet, Las Vegas, NV (US)

( * ) Notice: Subject to any disclaimer, the term of this patent is extended or adjusted under 35 U.S.C. 154(b) by 0 days.

(21) Appl. No.: 11/423,501

(22) Filed: Jun. 12, 2006

(51) Int. Cl.
*A63F 3/06* (2006.01)

(52) U.S. Cl. ..... 273/269; 463/19

(58) Field of Classification Search ..... 273/269, 273/270; 463/19
See application file for complete search history.

(56) References Cited

U.S. PATENT DOCUMENTS 2,760,619 A * 8/1956 Peak ..... 194/244
4,033,588 A * 7/1977 Watts ..... 463/18
4,218,063 A 8/1980 Cooper et al.
5,011,157 A 4/1991 Lovell, Sr. et al.
5,184,821 A * 2/1993 Korenek ..... 273/138.2
5,249,801 A * 10/1993 Jarvis ..... 273/148 R
2002/0094860 A1 * 7/2002 Itkis et al. ..... 463/19
2007/0060288 A1 * 3/2007 Willyard et al. ..... 463/19

OTHER PUBLICATIONS http://www.kardwell.com/bingo-machines.htm, Kardwell International Bingo Equipment & Supplies website, Aug. 2005.*
Santa Anita Stealt Verifier, by Santa Anita Bingo Equipment, a product design from Micrel Ltd. located at http://www.santa-anita.com/Products/Stealth_QuickStart.pdf, 1999.*

* cited by examiner

*Primary Examiner*—William M. Pierce
(74) *Attorney, Agent, or Firm*—Greenberg Traurig

(57) ABSTRACT

Described is an improved bingo flashboard that doubles as a verifier of winning bingo cards due to the capability to distinctly display a winning subset of bingo numbers called in a bingo game. In addition to highlighting the winning bingo numbers, the flashboard preferably highlights the winning bingo pattern and also displays the identification number of the winning bingo card along with the prize level and the prize amount of the winning bingo card. The flashboard is in communication with and controlled by a bingo caller terminal.

10 Claims, 4 Drawing Sheets

BINGO FLASHBOARD AND VERIFIER

FIELD OF THE INVENTION

The embodiments of the present invention relate to bingo flashboards, more specifically, to a bingo flashboard that facilitates in the verification process of a winning bingo card for a bingo game.

BACKGROUND

A bingo flashboard is a widespread feature of virtually every bingo hall across the country. Conventional bingo flashboards are disclosed in U.S. Pat. Nos. 4,218,063 and 5,011,157 to Cooper et al. and Lovell et al., respectively. Bingo flashboards are also described in numerous industry publications and product catalogs. Traditionally, bingo flashboards are used for the primary purpose of showing bingo numbers called in a current round of bingo game. Typically, the last called bingo number flashes on and off on a conventional bingo flashboard, as implied in the very name, flashboard. Although conventional bingo flashboards are quite large and easily discernable, their use is limited to displaying only the entire set of the called bingo numbers. Conventional flashboards are at best not optimal, and at worst detrimental, at the most critical point of the game, i.e., at the time of verifying a winning bingo card.

To alleviate the problem of lack of bingo card verification capability inherent in conventional flashboards, bingo halls are typically equipped with computer controlled TV monitors that display the winning bingo card to bingo players. Invariably, the TV monitors are rather small compared to the bingo flashboard and are therefore, difficult to discern for a majority of bingo players. In addition, TV monitors are a considerable expense for many, especially small charitable bingo halls.

Thus, there exists a need for an improved bingo flashboard, more particularly, a bingo flashboard to facilitate the bingo card verification process. In addition, there is also a need to make it easier for players to identify winning bingo numbers and discern winning bingo patterns, bingo cards, winning prize levels and prize amounts.

SUMMARY

Accordingly, one embodiment of the present invention is a bingo flashboard for a bingo game, comprising means for displaying a first and second set of bingo numbers, the first set of bingo numbers comprising an entire set of bingo numbers called in the bingo game, the second set of bingo numbers comprising a subset of the first set of bingo numbers, the subset belonging to a winning bingo card of the bingo game. In another embodiment, the bingo flashboard can display one or more of the following: (i) a winning bingo pattern; (ii) a winning bingo prize; (iii) a prize level of a winning bingo card; and (iv) an identification number of a winning bingo card.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
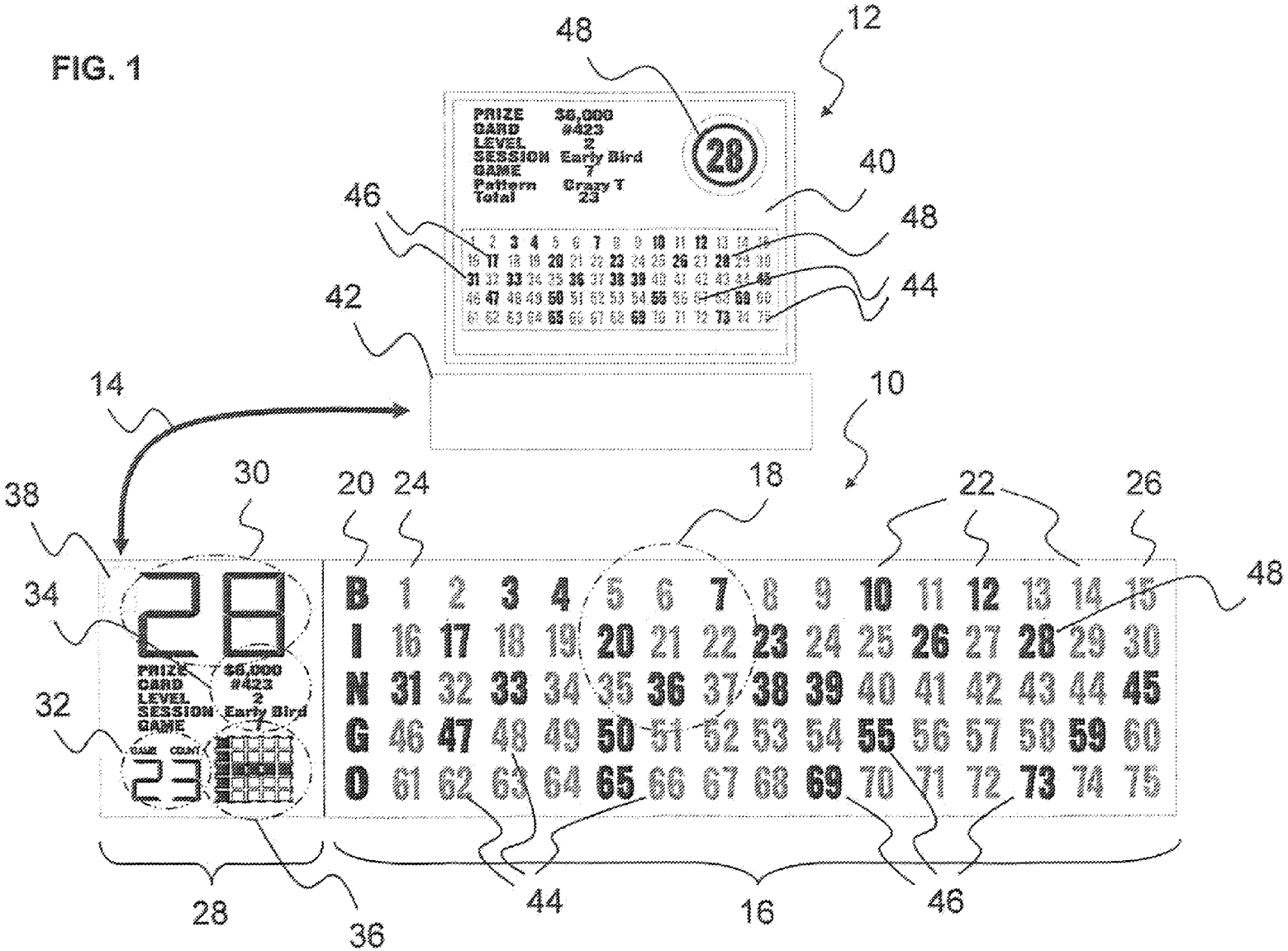
FIG. 1 illustrates a bingo caller terminal and a bingo flashboard displaying a first set of bingo numbers.

Initial reference is made to FIG. 1 illustrating a bingo flashboard 10 according to an embodiment of the present invention. The flashboard 10 can be coupled to a bingo caller terminal 12 via a wireless communication channel 14, preferably a WiFi network. The flashboard 10 can also be coupled to the bingo caller terminal 12 via a wired communication channel 14, such as Ethernet. The flashboard 10 includes a bingo numbers display panel 16 incorporating seventy-five bingo number light indicators 18 shaped as numbers one through seventy-five. The light indicators 18 are arranged in a matrix of five horizontal rows 20, each row 20 identified by a letter spelling out the word "BINGO," and fifteen vertical columns 22, starting with a first column 24 formed by the light indicators 18 "1, 16, 31, 46, 61," and ending with a fifteenth column 26 formed by the light indicators 18 "15, 30, 45, 60, 75." Ideally, the letters "B," "I," "N," "G" and "O" 20 are also implemented as light indicators 18 shaped as the respective letters. Preferably, the light indicators 18 are implemented as multi-color indicators, e.g., two-cathode tri-color light emitting diodes (LED's). However, other commonly known lighting systems and devices may be utilized.

The flashboard 10 also includes a game display panel 28 incorporating a two-digit number display 30, a two-digit game/session display 32, a multi-digit prize and card number display 34, and a pattern indicator 36 arranged in a five-by-five matrix of light indicator cells. It will be appreciated that the matrix of light indicator cells need not be in a five-by-five matrix, in particular, in the case of a 90-number, "British"-style flashboard. Additionally, the light indicator cells of the pattern indicator 36 can be constructed of the same or similar material as the light indicators 18 of the bingo numbers display panel 16. The flashboard 10 further incorporates a microcontroller 38 preferably, embedded within the game display panel 28 for receiving commands and instructions. Likewise, the microcontroller 38 can be embedded within the bingo numbers display panel 16.

Although the bingo flashboard 10 as described incorporates a bingo numbers display panel 16 having seventy-five bingo number light indicators 18, the bingo numbers display panel 16 can incorporate more than seventy-five light indicators 18. Likewise, the bingo numbers display panel 16 can have fewer than seventy-five light indicators 18. In addition, the layouts of the bingo numbers display panel 16 and the game display panel 28 are adjustable. For example, if more than one-hundred light indicators 18 are used in the bingo numbers display panel 18, the two-digit number display 30 on the game display panel 28 can be made to display three digits. Likewise, the two-digit game/session display 32 can also be made to display three digits. The shapes and sizes of the bingo numbers display panel 16 and the game display panel 28 can also be adjusted to accommodate each other.

The bingo caller terminal 12 includes a display monitor 40, such as a touchscreen LCD color monitor, and a central computer 42, such as a PC-compatible computer. The communication channel 14 interfaces the central computer 42 with the embedded microcontroller 38, which can also be another PC-compatible computer. Preferably, the microcontroller 38 is a single board PC computer. Via the communication channel 14, the central computer 42 is able to control and operate the embedded microcontroller 38, and through the latter, the central computer 42 ultimately controls the operation of the entire bingo flashboard 10.

It should be pointed out that the techniques of designing a bingo caller terminal 12, such as the one presently described, are well known and widely practiced in the bingo industry. Accordingly, the conventional details of implementing a PC-based bingo caller terminal 12 are omitted herein. Similarly, the conventional details of networking bingo caller terminals 12 with other PC-based bingo terminals, such as point-of-sale (POS) terminals and stationary and/or wireless bingo player terminals (not explicitly shown in FIG. 1) are also well known, widely practiced, and extensively disclosed. As such, these details, too, are also omitted herein. Preferably, the communication protocol between the bingo caller terminal 12 and the bingo flashboard 10 is based on a TCP/IP protocol. In the interest of brevity, the teaching of such conventional communication technique including methods of communicating between the central computer 42 and the microcontroller 38 are omitted. Likewise, methods of controlling the light indicators 18 and the light indicator cells of the pattern indicator 36 by the embedded microcontroller 38 are not elaborated herein, since they are well known to the practitioners of the art and are extensively disclosed. In particular, methods of controlling the intensity (brightness) and/or colors of the light indicators 18 and the light indicator cells of the pattern indicator 36 by pulse-width modulation are well known in the industry and therefore, not elaborated on herein. Similarly, the techniques of controlling the dot-matrix and/or seven-segment digital displays 30, 32, 34, 36 are also well known to the practitioners of the art. Therefore, the presently disclosed embodiments focus on non-trivial, bingo-specific aspects of operating the system as illustrated in FIGS. 1 and 2.

Figure 2:
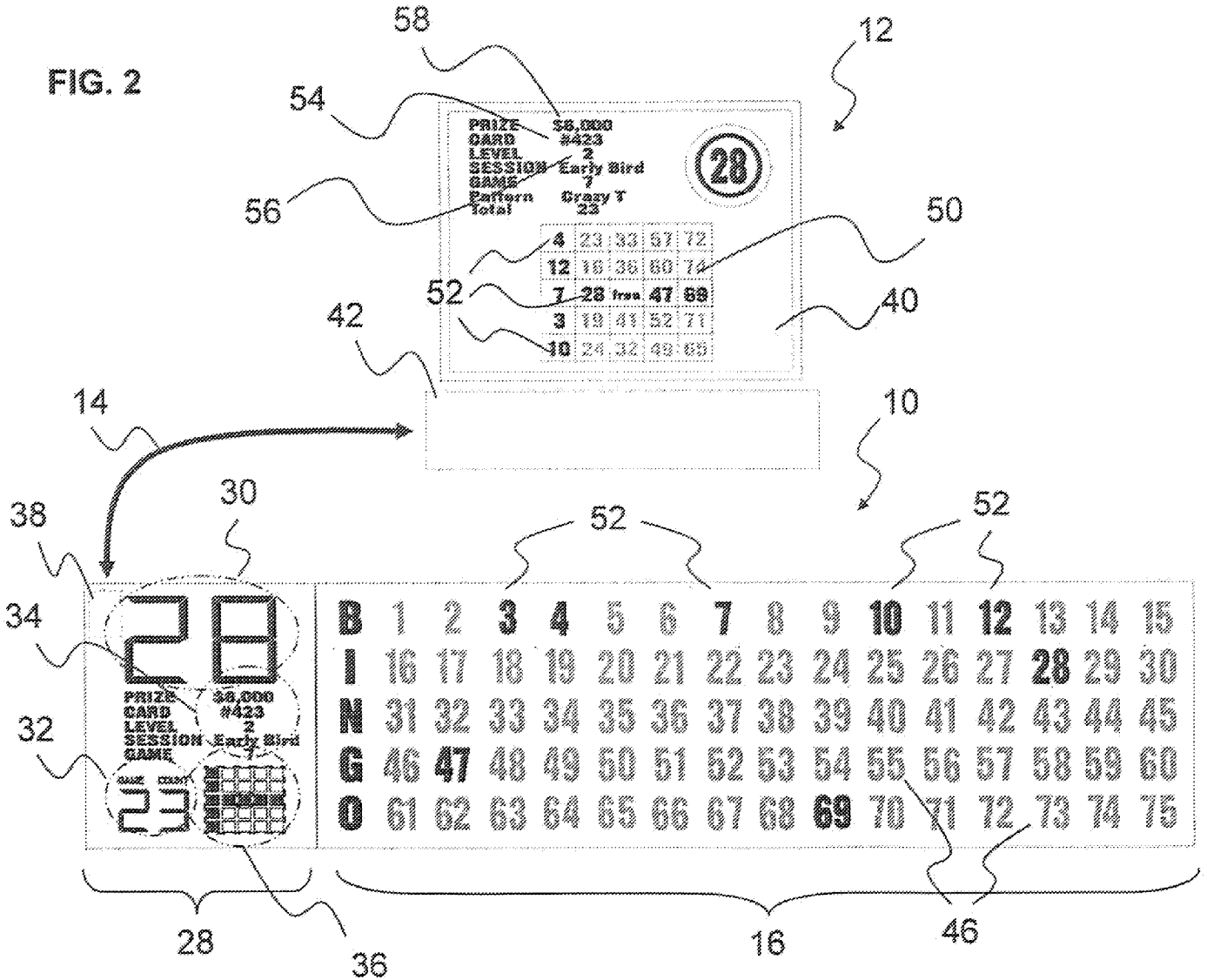
FIG. 2 illustrates a bingo caller terminal and a bingo flashboard displaying a second set of bingo numbers.

The process of playing and displaying a bingo game on the bingo flashboard 10 can be illustrated by referring to FIGS. 1 and 2. As illustrated in FIG. 1, bingo numbers that have yet to be called 44 remain dark or dimly lit on the bingo numbers display panel 16. As bingo numbers 46 are generated or called by either extracting bingo balls from a ball hopper (not explicitly shown in FIG. 1) or by randomly generating bingo numbers by the central computer 42, the called bingo numbers 46 become highlighted on the display monitor 40. The called bingo numbers 46 are also highlighted on by the light indicators 18 on the bingo numbers display panel 16. If bingo numbers are being randomly generated by the central computer 42, the called bingo numbers 46 can be highlighted simultaneously on the display monitor 40 and as light indicators 18, on the bingo numbers display panel 16. Note that in instances when the called bingo numbers 46 are being announced by a bingo caller (not shown) utilizing a ball hopper, the called bingo numbers 46 may have to be manually entered via the touchscreen LCD monitor 40 to cause the called bingo numbers 46 to be highlighted on the display monitor 40. Likewise, the bingo caller can enter the called bingo numbers 46 via the central computer 42. Regardless of whether the called bingo numbers 46 are manually or electronically generated, the central computer 42 communicates the called bingo numbers 46 from the bingo caller terminal 12 to the flashboard 10, more specifically, to the microcontroller 38 of the flashboard 10 via the communication channel 14, and the microcontroller 38 in its turn, causes the light indicators 18 of the matching called bingo numbers 46 to light up or be highlighted on the bingo numbers display panel 16 of the bingo flashboard 10.

As more and more bingo numbers are being called 46, the last bingo number being called 48 flashes on and off on the bingo numbers display panel 16 and on the display monitor 40. In addition, the last called bingo number 48 can be separately and prominently displayed on the bingo caller terminal 12 and on the two-digit number display 30 of the game display panel 28. As will be appreciated by one skilled in the art, the difference in the brightness and/or color among the uncalled bingo numbers 44, called bingo numbers 46 and the last bingo number being called 48 should be clearly apparent to bingo players by utilizing visual techniques known in the industry.

The advantages of the presently disclosed improved flashboard 10 will become more apparent as the bingo game reaches the stage of verifying a winning bingo card 50 displayed on the display screen 40 of the bingo caller terminal 12 as illustrated in FIG. 2. In such a situation, the central computer 42 transmits an information block (or a plurality of information blocks as may be appropriate) via a communication channel 14 detailing winning bingo numbers 52 that form a winning bingo pattern (a horizontally oriented letter "T") on the winning bingo card 50 to the embedded microcontroller 38 of the flashboard 10. In response, the embedded microcontroller 38 causes the bingo numbers display panel 16 to highlight only the winning numbers 52 and dim down or completely switch off the rest of the called bingo numbers 46. Along with the winning bingo numbers 52, the central computer 42 also transmits a winning card identification number 54 (also called "face number") to the embedded microcontroller 38, the latter able to cause the winning bingo card number 54 to be displayed on the multi-digit prize and card number display 34 of the game display panel 28. Preferably, the central computer 42 also transmits a winning prize level 56 to the embedded microcontroller 38. In return, the microcontroller 38 causes the winning prize level 56 to be displayed on the multi-digit prize and card number display 34 of the game display panel 28. Additionally, the central computer 42 can also transmit the winning bingo pattern of the winning card 50 and/or a winning prize 58 to the microcontroller 38, the latter causing the winning pattern 50 and the winning prize 58 to be displayed on the pattern indicator 36 and the multi-digit prize and card number display 34, respectively.

Figure 3:
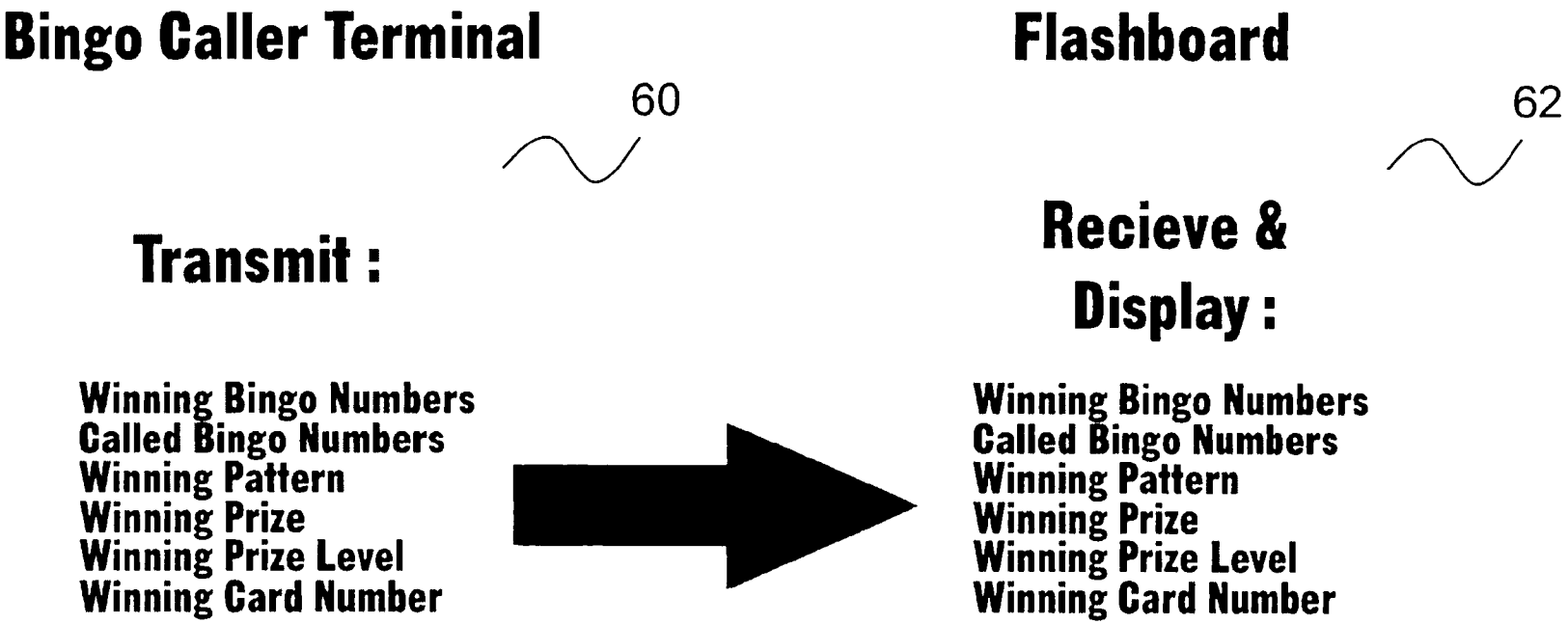
FIG. 3 illustrates a data flow diagram between a bingo caller terminal and a bingo flashboard.

The specifics of the data flow relevant to the winning card 50 are illustrated in FIG. 3, wherein data block 60 lists the types of data transmitted by the bingo caller terminal 12 while data block 62 illustrates the types of data being received and displayed by the bingo flashboard 10. As a result of processing data 62 received from the bingo caller terminal 12, the bingo flashboard 10 is able to display comprehensive information about the winning bingo card 50, specifically including the winning called bingo numbers 52, the winning pattern 50, the winning card identification number 54, the winning prize level 56 and the winning prize amount 58. By displaying all necessary winning card verification data 62, the flashboard 10 essentially functions as the winning card verification tool while preserving the conventional functions of a bingo flashboard.

Figure 4:
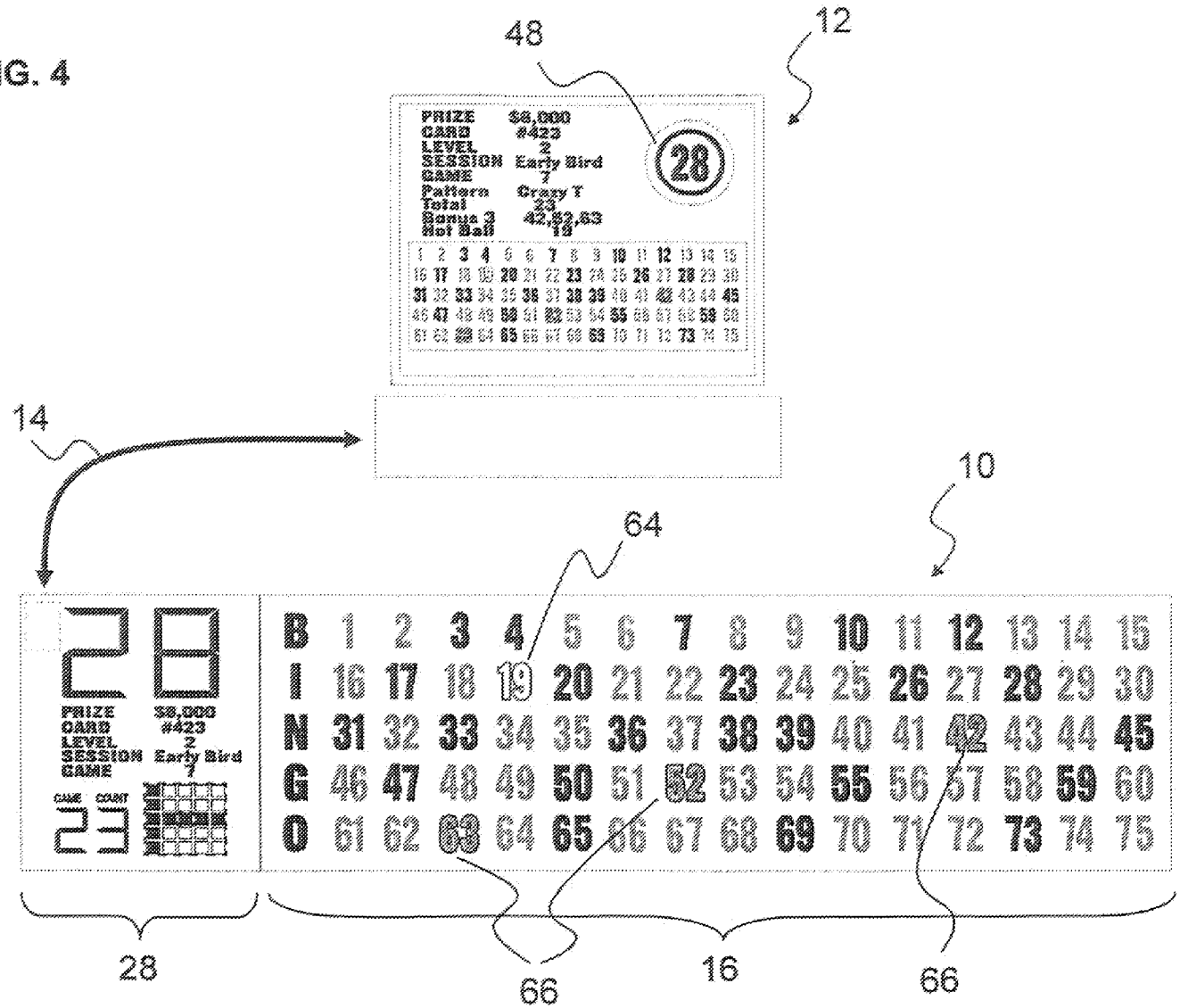
FIG. 4 illustrates a bingo caller terminal and a bingo flashboard displaying color indications of "hot balls" along with distinct representation of numbers called in a bingo game.

It should be obvious to those skilled in the art that various changes can be made without departing from the scope of the invention and the invention is not considered limited to what is specifically shown in the drawings and described in the specification. Particularly, the color light indicators 18 of the bingo flashboard 10 can display winning bingo numbers 52 in same or different colors than "uncalled" (not yet called) bingo numbers 44 or called bingo numbers 46. Moreover, being a color display, the flashboard 10 can display other important information relevant to the bingo game not described herein. Particularly, colors may be useful in indicating "special" bingo numbers and/or combinations of bingo numbers that yield special prizes. For example, the flashboard 10 can display in contrasting colors a "hot ball" 64 for a current bingo game as illustrated in FIG. 4. Similarly, the color flashboard 10 can display in yet other colors "leading bingo numbers" 66 (illustrated as 42, 52 and 63) or the first three bingo numbers called 66 in the current bingo game. In certain instances, bingo halls pay out jackpots if the last called winning bingo number 48 on the winning bingo card 50 matches the "hot ball" 64 and/or the first three (or sometimes, five) called bingo numbers 66. Like others, the information the bingo caller terminal 12 over the communication network 14.

Although the invention has been described in detail with reference to several embodiments, additional variations and modifications exist within the scope and spirit of the invention as described and defined in the following claims.

I claim:

1. A bingo flashboard for a bingo game, comprising:

a plurality of publicly displayed discrete light indicators, each said light indicator representing a unique bingo number, the total number of said light indicators equal to the total number of all bingo numbers available to be called during a bingo game; and a controller, in communication with a central computer, causing to display on said flashboard a first and second set of said light indicators distinctive from a rest of said light indicators, the first set of said light indicators representing an entire set of bingo numbers called during the bingo game, the second set of said light indicators representing a subset of the first set of bingo numbers, the subset representing only called bingo numbers belonging to a winning bingo card of the bingo game wherein said subset includes less of said light indicators than the first set of said light indicators whereby said subset remains displayed while light indicators from said first set of light indicators not belonging to a winning bingo card are altered automatically to appear distinct from said subset responsive to a winning bingo card being identified by said central computer.

2. The bingo flashboard according to claim 1, further comprising means for displaying one or more of the following:

(i) a winning bingo pattern;

(ii) a winning bingo prize;

(iii) a prize level of a winning bingo card; and (iv) an identification number of a winning bingo card.

3. The bingo flashboard according to claim 2, wherein the bingo flashboard is operable to receive data identifying one or more of the following:

(i) the first set of bingo numbers;

(ii) the second set bingo numbers;

(iii) the winning bingo pattern;

(iv) the winning bingo prize;

(v) the prize level of the winning bingo card; and (vi) the identification number of the winning bingo card.

4. The bingo flashboard according to claim 1, the bingo flashboard further comprising a plurality of color light indicators.

5. The bingo flashboard according to claim 1, further comprising means for displaying one or more of the following:

(i) a set of called bingo numbers called first in the bingo game;

(ii) a predetermined bingo number associated with a specific bingo prize; and (iii) a color of a winning bingo card.

6. A method of verifying a winning bingo card in a bingo game, the method comprising:

providing a bingo flashboard including a plurality of publicly displayed discrete light indicators, each said light indicator representing a unique bingo number, the total number of said light indicators equal to the total number of all bingo numbers available to be called during a bingo game;

distinctly displaying on said flashboard a first set of said light indicators representing an entire set of bingo numbers called during the bingo game; and responsive to a winning bingo card being identified by a central computer automatically altering an appearance of certain light indicators within said first set of light indicators such that a second set of said light indicators representing a subset of the first set of said light indicators is readily distinct from said altered light indicators from said first set of light indicators, the subset representing only called bingo numbers belonging to the winning bingo card of the bingo game wherein said subset includes less of said light indicators than the first set of said light indicators.

7. The method according to claim 6, further comprising displaying one or more of the following:

(i) a winning bingo pattern;

(ii) a winning bingo prize;

(iii) a prize level of a winning bingo card; and (iv) an identification number of a winning bingo card.

8. The method according to claim 7, further comprising receiving data identifying one or more of the following:

(i) the first set of bingo numbers;

(ii) the second set bingo numbers;

(iii) the winning bingo pattern;

(iv) the winning bingo prize;

(v) the prize level of the winning bingo card; and (vi) the identification number of the winning bingo card.

9. The method according to claim 6, further comprising displaying said first set of bingo numbers and said second set of bingo numbers utilizing a plurality of color light indicators on the bingo flashboard.

10. The method according to claim 6, further comprising displaying one or more of the following:

(i) a set of called bingo numbers called first in the bingo game;

(ii) a predetermined bingo number associated with a specific bingo prize; and (iii) a color of a winning bingo card.

* * * * *